United States Patent [19]

de Vries et al.

[11] Patent Number: 4,571,522

[45] Date of Patent: Feb. 18, 1986

[54] METHOD OF MANUFACTURING A LOW-PRESSURE MERCURY VAPOR DISCHARGE LAMP, A LOW-PRESSURE MERCURY VAPOR DISCHARGE LAMP MANUFACTURED BY MEANS OF THIS METHOD, AND A DEVICE FOR CARRYING OUT THIS METHOD

[75] Inventors: Jan de Vries, Roosendaal; Jacob W. de Ruiter, Eindhoven, both of Netherlands

[73] Assignee: U.S. Philips Corporation, New York, N.Y.

[21] Appl. No.: 607,910

[22] Filed: May 7, 1984

[30] Foreign Application Priority Data

May 20, 1983 [NL] Netherlands ..... 8301797

[51] Int. Cl.[4] ..... H01J 1/62; H01J 63/04; B05D 3/02; B05D 5/06

[52] U.S. Cl. ..... 313/485; 427/45.1; 427/64; 427/66; 445/58

[58] Field of Search ..... 427/64, 66, 45.1; 313/485; 445/26, 58

[56] References Cited

U.S. PATENT DOCUMENTS 3,484,276 12/1969 Burggraaf et al. ..... 427/45.1 X

*Primary Examiner*—Michael R. Lusignan

*Attorney, Agent, or Firm*—Norman N. Spain

[57] ABSTRACT

A method of manufacturing a low-pressure mercury vapor discharge lamp comprising a discharge tube (1), to the inner wall of which is applied a layer of luminescent material (4) by means of a suspension of the luminescent material, which suspension is brought into contact with this inner wall in such a manner that a layer of suspension adheres thereto, the non-adhered suspension disappearing from the tube, after which the layer is dried by heating a zone (14) of this layer extending along the tube circumference by means of a high-frequency electric field which from a starting point near the upper end of the tube performs such a movement with respect to the tube that the zone moves towards the lower end of the tube.

5 Claims, 5 Drawing Figures

METHOD OF MANUFACTURING A LOW-PRESSURE MERCURY VAPOR DISCHARGE LAMP, A LOW-PRESSURE MERCURY VAPOR DISCHARGE LAMP MANUFACTURED BY MEANS OF THIS METHOD, AND A DEVICE FOR CARRYING OUT THIS METHOD

The invention relates to a method of manufacturing a low-pressure mercury vapour discharge lamp comprising a discharge tube, to the inner wall surface of which tube is applied a layer of luminescent material by means of a suspension of the luminescent material, which suspension is brought into contact with the inner wall surface of the tube in such a manner that a layer of suspension adheres thereto, the tube being arranged in such a position that the suspension not adhered to it disappears therefrom, after which the suspension layer adhered to the inner wall surface of the tube is dried. Such a method is known from British patent specification No. 1,232,737.

In the known method, a quantity of a suspension liquid is introduced into a vertically arranged tube preferably open at both ends, for example by spraying from above. A thin layer of suspension is formed on the inner wall of the tube, the grains of luminescent material having adhered both to the glass wall and to each other. The excess quantity of suspension flows out of the tube. The layer adhered to the wall is then dried by blowing dry hot air through the tube. When the air is blown in immediately after application, the suspension medium avaporates and a layer of luminescent material is formed. In order to obtain a luminescent layer of a uniform thickness throughout the inner wall surface of the tube, a comparatively long drying time has proved necessary. This is a disadvantage especially in a mass production process. Although the drying time can be shortened by increasing the quantity of dry air to be blown through the tube per unit time or by raising the ambient temperature of the tube, it has been found that, after the tube has been dried (which drying procedure also in this case is carried out with a tube in a vertical position), the thickness of the luminescent layer on the wall portions near the upper end of the tube was considerably less than the thickness of the layer on the wall portions located near the lower end. A discharge tube, on the inner wall surface of which such a non-uniform distribution of the luminescent material is present, has, when used in a finished lamp, an inhomogeneous light intensity during operation of this lamp. At the areas at which the thickness of the luminescent layer is relatively small there is moreover a risk of interaction between the mercury atmosphere and the glass wall, which is liable to result in greying of the wall during operation.

An object of the invention is to provide a method of manufacturing a low-pressure mercury vapour discharge lamp, wherein the aforementioned disadvantages are at least mitigated and in which the time for drying the layer of the suspension on the inner wall of the tube is comparatively short.

According to the invention, a method of the kind mentioned in the opening paragraph is therefore characterized in that the tube is arranged in a non-horizontal position, in which the suspension layer is dried by heating a zone of this layer extending along the tube circumference by a high-frequency electric field, which from a starting-point near the upper end of the tube performs such a movement with respect to the tube that the zone is displaced towards the lower end of the tube.

In the method according to the invention, the wet suspension layer on the inner wall of the tube is heated end dried in a comparatively short time. In this method, the frequency of the electric field is chosen so that the glass wall of the tube is prevented from being excessively heated. Favourable results were obtained with frequencies between 1 MHz and 1000 MHz. After heating and drying during the said short period of time, a luminescent layer is obtained whose thickness, measured over the whole inner wall, is remarkably uniform as compared with the thickness of a layer obtained by the known method and dried in the same short time. It has been found that the method is particularly suitable to be used in a mass production process.

The uniform layer is obtained by causing the tube and the field to perform a movement with respect to each other, in which the zone of the wet layer located near the upper end of the tube is heated by means of the high-frequency electric field until the suspension medium (preferably consisting of an aqueous solution) has evaporated. The electric field moves (preferably at a uniform speed) along the tube wall to the lower side. The layer on an adjoining wall portion at a lower level than that of the zone mentioned above before being subjected to high-frequency heating initially is caused to have a lower viscosity, a part of the suspension present at this area flowing away. For this purpose, the tube is arranged during heating at least in an oblique position with respect to the horizontal plane. The tube preferably occupies a vertical position. Subsequently, the layer is dried. With a suitable choice of the viscosity of the suspension and the speed at which the electric field moves with respect to the tube wall, it is achieved that the thickness of the dried layer is substantially equally large throughout the tube wall.

It has been found that the method can be advantageously used for suspensions of a luminescent material comprising a mixture of a number of different phosphors, for example phosphors which emit light of different wavelenths upon excitation by resonance radiation of mercury. It has in fact been found that due to the speed at which the drying process is carried out in the method according to the invention as compared with the known method, demixing substantially does not occur. Demixing results during operation of such a lamp in undesired colour differences over the surface of the lamp.

In order to obtain a satisfactory heating of the suspension layer, a good conduction of the energy from the high-frequency electric field is necessary. The liquid in which the luminescent material is dissolved (suspension medium) should have a sufficient electrical conductivity. An example of a suitable suspension medium is water, to which a small, but sufficient, quantity of a basic liquid, for example $NH_4OH$, and a binder, such as carboxymethylcellulose, are added. Such a binder serves to improve the adhesion to the wall and is removed afterwards by burning in a sintering furnace.

The German Patent Specification No. 1,108,322 discloses a method of manufacturing tubular discharge lamps, in which undesired gases and other impurities are removed from the lamp wall after a luminescent layer has been applied and has been subjected to a sintering process by heating the lamp wall by a high-frequency electric field. This field is produced between two capacitor plates substantially entirely enclosing the tubular lamp. These plates are moved at a comparatively high speed along the outer wall of the lamp, the direction of movement being preferably chosen so that undesired released gases are driven away in front of the field, move to an exhaust tube and at this tube leave the lamp vessel. However, in the said Patent Specification nothing is stated about drying layers of suspensions of luminescent materials in tubes suitable for discharge lamps and about the specific advantages involved.

In the method according to the invention, the high-frequency heating of the suspension layer is preferably started immediately after the layer has been provided in the tube. The high-frequency electric field can be produced between two capacitor plates which are arranged on either side of the tube and which are moved, for example, from the upper end of the tube to the lower end. The field lines are then substantially at right angles to the longitudinal axis of the tube. In order to obtain a sufficient heating of the suspension layer throughout the circumference of the tube, the tube is rotated about its longitudinal axis during the application of the field. However, especially in a mass production process this method is rather complicated.

In an embodiment of the method according to the invention, the electrodes between which the high-frequency electric field is maintained are preferably arranged on either side of the tube to be dried so that the field lines of the high-frequency electric field extend parallel to the longitudinal axis of the tube. The advantage of such an arrangement is that during heating rotation of the tube is avoided. Moreover, the use of special holders for rotating the tubes is superfluous.

In a special embodiment, the electrodes are in the form of two pairs of parallel extending metal rods or elongate plates which are positioned at an angle to the horizontal plane. A vertically arranged tube then moves in a horizontal direction between the two pairs of these electrodes at a speed which depends inter alia upon the viscosity of the suspension and upon the speed at which the suspension drips out of the tube.

The method can be used for manufacturing different types of low-pressure mercury vapour discharge lamps, for example lamps comprising an elongate discharge tube having an inner diameter of 26 mm. It has been found that the method can also be suitably combined with known drying methods, such as drying with air or drying by heat radiation. An example of a combination of the method according to the invention with a conventional method of drying with air is a method in which in a vertically arranged tube a part near the apex of the tube is dried by high-frequency heating by means of the method according to the invention and a part near the centre (at which preferably supporting means for positioning the tube are present) is dried by blowing hot air, while the lower part is heated by means of a high-frequency electric field.

In another embodiment, the layer at the upper end of the tube is heated by infrared radiation and the drying process by means of the method according to the invention starts at a certain distance from said upper end.

The invention will be described more fully with reference to the drawing.

Figure 2:
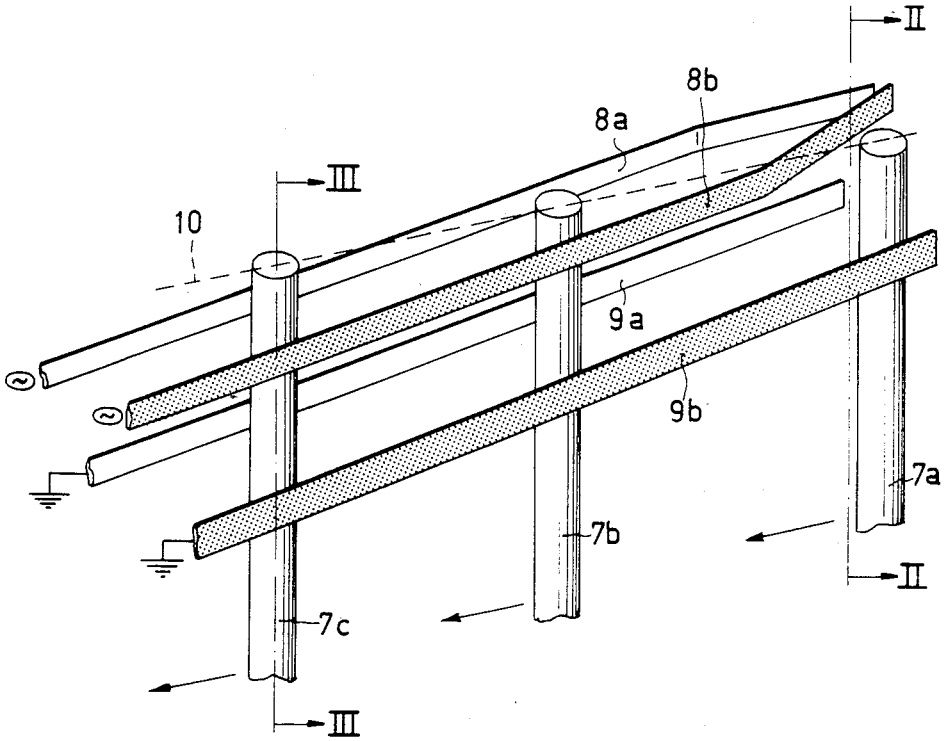
FIG. 2 shows also diagrammatically an embodiment of a device provided with electrode pairs for carrying out the method.
Figure 3A:
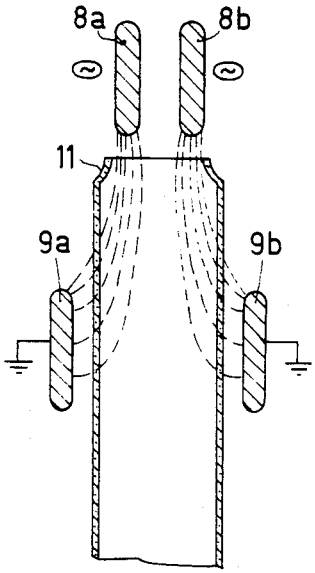
Figure 3B:
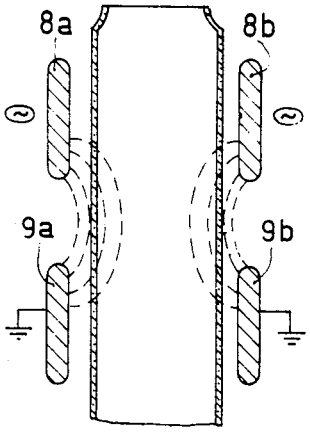
Figure 4:
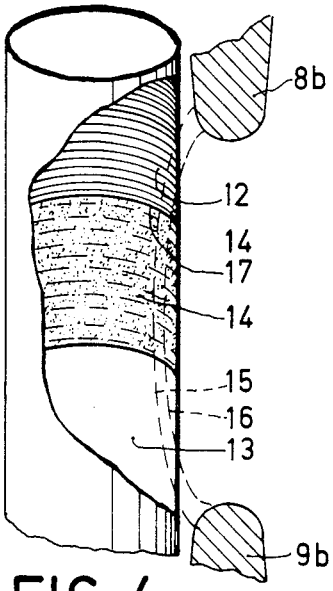

FIG. 3*a* is a cross-sectional view of the device shown in FIG. 2 taken on the plane II—II, in which a tube is present for illustration;

FIG. 3*b* is also a cross-section of the device shown in FIG. 2 taken on the plane III—III and FIG. 4 shows a part of the inner wall of a tube provided with a suspension layer which is dried by means of the method according to the invention.

Figure 1:
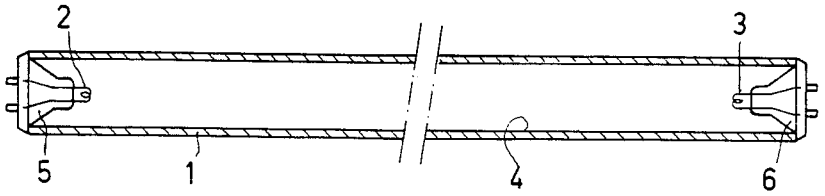
FIG. 1 shows diagrammatically in longitudinal sectional view a low-pressure mercury vapour discharge lamp which is manufactured by means of a method according to the invention.

The low-pressure mercury vapour discharge lamp shown in FIG. 1 comprises a glass discharge tube 1 which is sealed in a vacuum tight manner and contains mercury and a rare gas, a discharge being maintained between electrodes 2 and 3 during operation of the lamp. The inner wall surface of the tube is provided with a luminescent layer 4, for converting the ultraviolet radiation produced in the mercury discharge is converted into visible light. The lamp is manufactured by means of the method according to the invention, in which a glass tube open at both ends is first provided with a luminescent layer, whereby, after drying this layer and removing a binder present in the suspension medium by sintering, the mounts 5 and 6 (carrying the electrodes 2 and 3, respectively, and further provided with an exhaust tube) are secured in the open ends of the tube in a vacuum-tight manner. The tube is then exhausted; the rare gas atmosphere is produced; the exhaust tubes are sealed in a vacuum-tight manner and finally the mercury is introduced into the tube, for example by means of a method as described in GB-PS No. 1,475,458.

Before the layer is applied to the inner wall of the tube, the luminescent material is first introduced into a suspension. The suspension medium (for example water to which a small quantity of a basic liquid, such as $NH_4OH$, is added) has also added to it the binder (such as carboxy-methylcellulose). A quantity of the suspension liquid is formulated into the preferably vertically arranged tube by spraying from above. The suspension then comes into contact with the inner wall surface of the tube, whereby a part of the suspension adheres thereto as a layer. The suspension which has not adhered drips out of the tube as the lower end. Also during this dripping, the tube preferably maintains its vertical position.

FIG. 2 shows by way of example three tubes 7*a*, 7*b* and 7*c*, which move in horizontal direction. The direction of which is indicated by arrows. The tubes are transported through a conveyor belt and are arranged in vertical position by holders (not shown). The wet layer adhered to the inner wall surface of a tube 7*a* is dried by means of a high-frequency electric field (frequency in a practical embodiment 27, 12 MHz). The suspension medium then evaporates. The tube need then not be rotated about the longitudinal axis. It has been found that the layer is dried in the field throughout the circumference of the tube; the layer is dried first at the area at which the intensity of the field lines is a maximum. The dried part then spreads gradually in a horizontal plane throughout the circumference. The high-frequency electric field is maintained between electrodes (8*a*,9*a*) and (8*b*,9*b*) which are in the form of two pairs of parallel extending flat metal rods, which are at an angle (for example of 20°) to the horizontal plane 10. The electrodes 8*a* and 8*b* are connected to a supply phase and the electrodes 9*a* and 9*b* are connected to earth. In the drawing, for the sake of clarity the usual symbols are shown next to the electrodes.

During drying, the lines of the electric field extend substantially parallel to the longitudinal axis along the wall of the tube (see also FIGS. 3*a* and 3*b*). A vertically arranged tube moves between the two pairs of electrodes in horizontal direction, whereby invariably only a comparatively small part of the wet suspension layer on the tube wall is subjected to heating by the electric field. This can be illustrated as heating of a zone which extends throughout the tube circumference and which (due to the oblique position of the electrodes with respect to the direction of movement of the tube) performs from a starting point near the upper end of the tube such a movement towards the lower end of the tube that the part of the suspension layer just dried likewise moves at a uniform speed to the lower end of the tube.

In FIG. 3*a* the field lines are shown which are present for drying a zone near the apex of the tube. In this case, the electrodes 8*a* and 8*b* are situated very close to each other (see also FIG. 2). It is then achieved that also the suspension layer at the area of the rib 11 located at the upper end is dried sufficiently by means of the electric field. FIG. 3*b* shows a situation in which the zone is present somewhere between the ends of the tube. The electrodes 8*a*, 8*b*, 9*a* and 9*b* are located on either side of the tube, the electrodes 8*a* and 9*a* and 8*b* and 9*b*, respectively, being located in a plane parallel to the longitudinal axis of the tube.

FIG. 4 shows in detail an arbitrary part of the inner wall surface of the tube. The luminescent layer already dried is designated by reference numeral 12. The wet layer still to be dried is designated by reference numeral 13. However, the cylindrical zone 14 lying between these layers is heated by the field (of which only two field lines 15 and 16 are illustrated by way of example), it is true, but is not yet dried completely. The layer at the area of the zone 14 due to the heating initially obtains a lower viscosity, whereby a part of the suspension flows downwards. The remaining part of this suspension in 14 is then immediately dried ultimately, it then being found that the layer thickness, inter alia due to the vertical position of the tube, is an optimum and is equal to the thickness of the layer at the area 12. At the separation line between the parts 12 and 14 there is located a drying front 17. With a suitable choice of the speed at which a tube is passed through the electrodes and a suitable choice of the viscosity and the conductivity of the suspension medium, the drying front keeps place with the field and a uniform dried layer is obtained on the inner wall of the tube. The tube with the dried layer is then transferred to a sintering furnace, the binder (for example carboxymethylcellulose) being removed by burning.

In a practical embodiment of the method, the luminescent material consists of a mixture of three phosphors, i.e. blue luminescing barium magnesium aluminate activated by bivalent europium, green luminescing terbium-activated cerium magnesium aluminate and red luminescing yttrium oxide activated by trivalent europium. The suspension medium of the luminescent material is water to which a small quantity of $NH_4OH$ is added. Further, the binder carboxymethylcellulose (0.75% by weight) is dissolved in this suspension medium.

The distance between the axis of the aluminium electrode rod 8*a* and the axis of the electrode rod 8*b* (see FIG. 3*b*) was 10 cm. The distance between 8*b* and 9*b* was also 10 cm. The rods themselves had a thickness of approximately 1 cm and a height of 4 cm. The distance between the rods 8*a* and 8*b* according to FIG. 3*a* was 5 cm. The electrodes 8*a* and 8*b* are connected to a high-frequency generator having a power of 8 kW (3.5 kV) and a frequency of 27.12 MHz (method of capacitive heating). The electrodes 9*a* and 9*b* are connected to earth. Any disturbing influence of earth's fields is then avoided. The angle to the horizontal plane was 20°. The tubes were passed through the electrode pairs at a speed of approximately 3 cm/s.

It has been found that tubes having a length of 5 ft and an inner diameter of 25 mm (intended to be used in lamps of 40 W) were dried in 60 to 90 seconds, a substantially uniform layer (thickness approximately 40 μm) being obtained.

A lamp provided with a discharge tube dried by means of the method substantially did not exhibit colour differences over its surface during operation.

What is claimed is:

1. In a method of manufacturing a low-pressure mercury vapour discharge tube comprising a discharge tube, by applying to the inner wall surface of said tube a suspension of a luminescent material in a manner such that a layer of said suspension adheres to said wall surface and that any non-adhering portion of the suspension is removed from said wall surface and drying said suspension layer adhering to said wall surface, the improvement comprising arranging said tube in a non-horizontal position and drying the suspension layer adhering to said wall surface while said tube is arranged in said non-horizontal position by heating a zone of said suspension layer extending along the circumference of said tube by means of a high frequency electrical field, said field being positioned so relative to said tube such that said zone is displaced towards the lower end of said tube from a starting zone near the upper end of said tube.

2. A method as claimed in claim 1, characterized in that the tube occupies a vertical position during the high-frequency heating of the suspension layer.

3. A method as claimed in claim 1, characterized in that the field lines of the high-frequency electric field extend substantially parallel to the longitudinal axis of the discharge tube.

4. A method as claimed in claim 1, characterized in that the high-frequency electric field is produced by electrodes which are in the form of two pairs of parallel extending metal rods which are at an angle to the horizontal plane, the tube moving in a substantially vertical position between the pairs in horizontal direction.

5. A low-pressure mercury vapour discharge lamp manufactured by means of a method claimed in claim 1.

* * * * *